United States Patent [19]

Murakami et al.

[11] Patent Number: 5,003,319

[45] Date of Patent: Mar. 26, 1991

[54] MICROSTRIP ANTENNA DEVICE FOR CIRCULARLY POLARIZED WAVES

[75] Inventors: Yuichi Murakami; Kiyokazu Ieda, both of Tokyo, Japan

[73] Assignee: Aisin Seiki Kabushikikasha, Aichi, Japan

[21] Appl. No.: 102,732

[22] Filed: Sep. 30, 1987

[30] Foreign Application Priority Data

Sep. 30, 1986 [JP] Japan ..... 61-232991

[51] Int. Cl.[5] ..... H01Q 1/32

[52] U.S. Cl. ..... 343/700 MS

[58] Field of Search ..... 343/700 MS, 846, 848, 343/829

[56] References Cited

U.S. PATENT DOCUMENTS 4,051,478 9/1977 Kaloi ..... 343/700 MS 4,125,837 11/1978 Kaloi ..... 343/700 MS

OTHER PUBLICATIONS

Construction of a Microstrip Antenna for Circularly Polarized Waves with One Feeder Point, Haneishi et al. (Apr. 1987).

Microstrip Antennas, John Q. Howell, IEEE Transactions on Antennas and Propagation, vol. AP-23, No. 1 (Jan. 1975).

Edge Effects of Microstrip Antennas, Mishao Haneishi, et al. (Apr. 1987).

*Primary Examiner*—Michael C. Wimer

*Attorney, Agent, or Firm*—Banner, Birch, McKie & Beckett

[57] ABSTRACT

A microstrip antenna device for circularly polarized waves includes a dielectric sheet member, one surface of which has a radiating conductor sheet member while the opposite surface has a ground conductor sheet member. Denoting a point where a segment of a line passing through a geometrical center o, o of the radiating conductor sheet member intersects with the substantial periphery of the radiating conductor sheet member by a and denoting a point where the segment intersects with the substantial periphery of the ground conductor sheet member by b, the ratio of the length between the points o and b to the length between the points o and a should be at least equal to 1.5. Where rectangular radiating and ground conductor sheet members are used, a good circular polarization is achieved without any disturbance in the radiating pattern when the diagonal ratio of the respective members is equal to or greater than 1.5.

13 Claims, 4 Drawing Sheets

MICROSTRIP ANTENNA DEVICE FOR CIRCULARLY POLARIZED WAVES

BACKGROUND OF THE INVENTION

This invention generally relates to a microstrip antenna device for circularly polarized waves.

A microstrip antenna comprises a dielectric sheet with a conductor mounted on one surface and a ground conductor mounted on the other surface. Such an antenna utilizes the radiation loss of an open planar resonance circuit. Attention is now being focused on such microstrip antennas because of their low profile, reduced weight, compactness and ease of manufacture.

FIG. 7 shows one form of a conventional microstrip antenna device for circularly polarized waves. As shown, the device comprises a dielectric sheet 110 which is sufficiently thin with respect to the wavelength used. One surface of dielectric sheet 110 has a radiating conductor sheet 120 formed from a copper foil while the other surface is entirely covered with a ground conductor sheet 130 also formed from a copper foil. This arrangement defines a microstrip antenna device. The device further includes a feeder in which a small hole 111 is formed that extends through the dielectric sheet 110, the radiating conductor sheet 120 and the ground conductor sheet 130. A connector 140, or more precisely, an external conductor associated therewith, is soldered to the ground conductor sheet 130. The internal conductor or core of the connector 140 is connected to a gold plated wire 141 which is soldered to the feeder portion of the radiating conductor sheet 120. The hole 111 is filled with an insulating material, not shown, which insulates the wire 141 from the ground conductor sheet 130. The connector 140 is coupled to a coaxial cable 150 which is in turn connected to the high frequency amplifier of a receiver unit, as indicated by an arrow designated R.F.Amp.

In the above-described microstrip antenna device for circularly polarized waves, the size of the radiating conductor sheet 120 is determined by the wavelength involved. No definite figure is given for the size of the ground conductor sheet 130, although it should theoretically be infinitely extensive in order to eliminate fringing effects. However, an infinitely extensive sheet is impractical and it has been the prior art practice that a sheet 130 of a size sufficiently larger in comparison to the size of the radiating conductor sheet 120 may be used. For example, sheet 130 may have one side which is three to four times as long as that of the radiating conductor sheet which is used to define a microstrip antenna device. When the radiating pattern which is actually generated is close to an ideal pattern and the axial ratio which is actually produced may be considered as representing a circularly polarized wave, it is concluded that the antenna device is adapted for practical use.

FIG. 4 shows an ideal radiating pattern for a microstrip antenna device for circularly polarized waves. The ideal pattern is indicated by the solid curve having a half-value angle $\theta_0$ of about 75° where a 3 dB reduction occurs and a lateral depression of about 14 dB.

Because of the low profile, light weight and compactness of the microstrip antenna, it is frequently mounted in a restricted space. In such applications, it is desirable that the antenna be as small as possible so long as it provides a comparable characteristic. However, such a requirement cannot be met with the conventional microstrip antenna. There have been no teachings in the prior art which permit this goal to be attained, despite the advantages associated therewith.

SUMMARY OF THE INVENTION

It is an object of the invention to reduce the size of a microstrip antenna device for circularly polarized waves in order to enhance its use in restricted areas.

Accordingly, the invention provides a microstrip antenna device for circularly polarized waves including a dielectric sheet, one surface of which has a radiating conductor sheet member while the other surface has a ground conductor sheet member. The point where a line segment which passes through the geometrical center o, o of the radiating conductor sheet member intersects with the substantial periphery of the conductor sheet member is denoted by a. The point where this line segment intersects with the substantial periphery of the ground conductor sheet member is denoted by b. The ratio of the distance between the points o and b and the distance between the points o and a should be at least equal to 1.5. For example, where the radiating and the ground conductor sheet members are rectangles which are oriented such that normals passing through the center of the respective members coincide with each other, there is satisfactory circular polarization when the diagonal ratio is equal to or greater than 1.5. In this case, a microstrip antenna device for circularly polarized waves is produced having a radiating pattern which exhibits no disturbance and which is satisfactory for practical use. In this manner, the size of the microstrip antenna is reduced to effect the efficient utilization of restricted space.

BRIEF DESCRIPTION OF THE DRAWINGS

A more complete appreciation of the invention and many of the attendant advantages thereof will be readily obtained as the invention becomes better understood by reference to the following detailed description when considered in connection with the accompanying drawings wherein.

DETAILED DESCRIPTION

Figure 1:
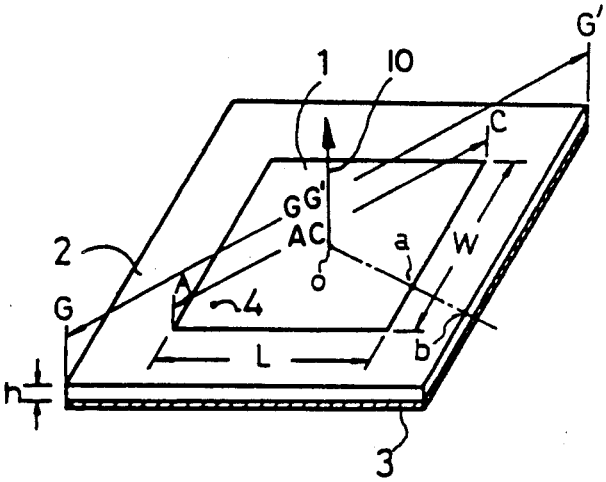
FIGS. 1 and 2 are a perspective view and a side elevation, respectively, of a microstrip antenna device for circularly polarized waves according to one embodiment of the invention.
Figure 2:
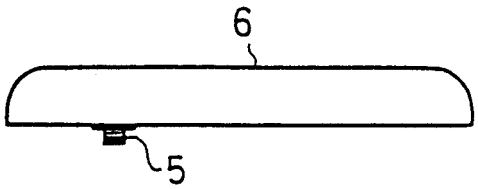
Figure 7:
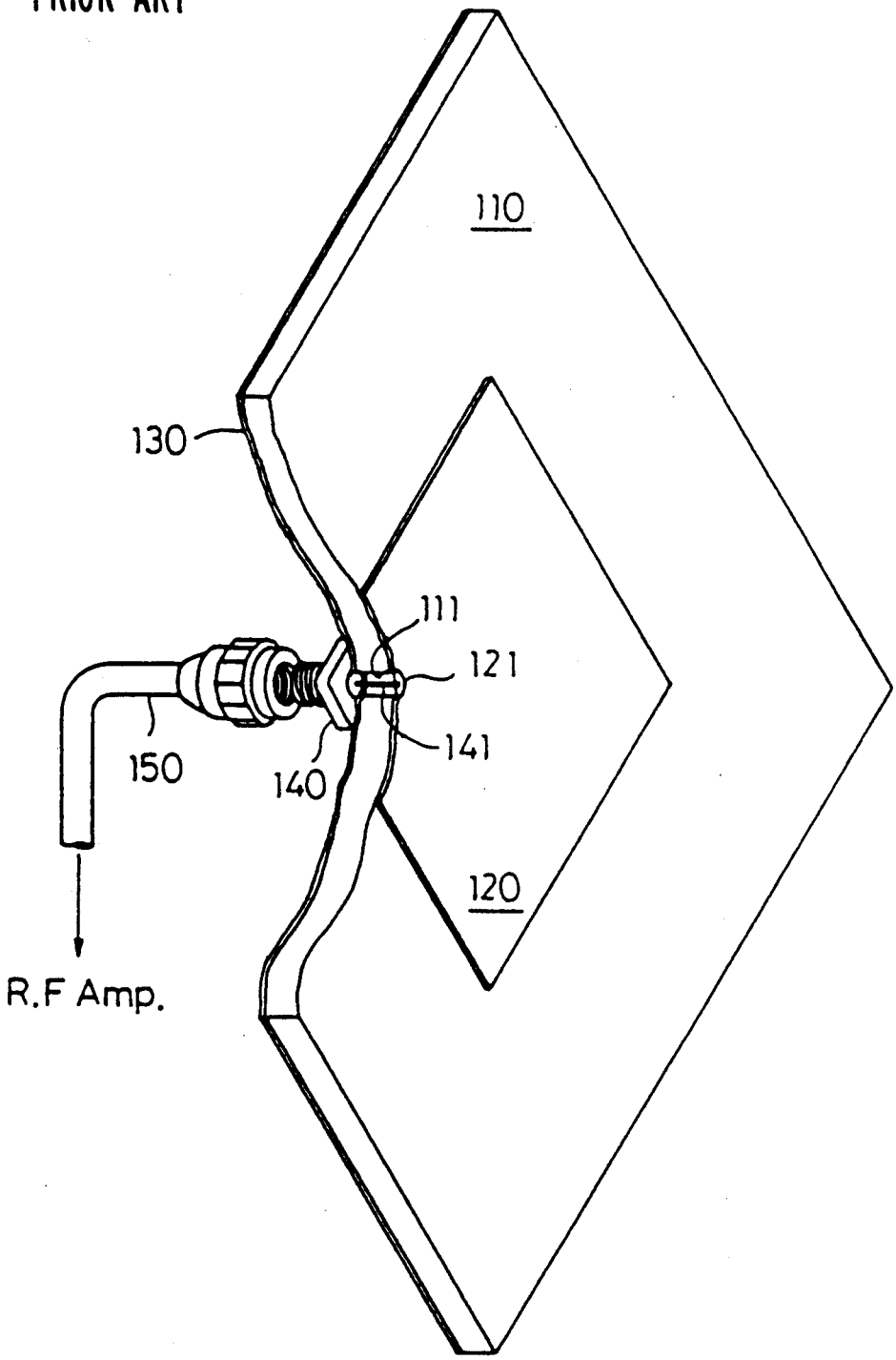
Fig.7 PRIOR ART
FIG. 7 is a perspective view of a conventional microstrip antenna device for circularly polarized waves.

FIG. 1 is a perspective view of a microstrip antenna device for circularly polarized waves according to one embodiment of the present invention. The construction of the antenna device is similar to that shown in FIG. 7 and comprises a dielectric sheet 2, one surface of which has a radiating conductor sheet 1 while the other surface has a ground conductor sheet 3. A feeder point 4 is located as shown. As illustrated in FIG. 2, a radome 6 is mounted on the antenna device for use. As shown, the back surface of the antenna device is provided with a connector 5.

Figure 4:
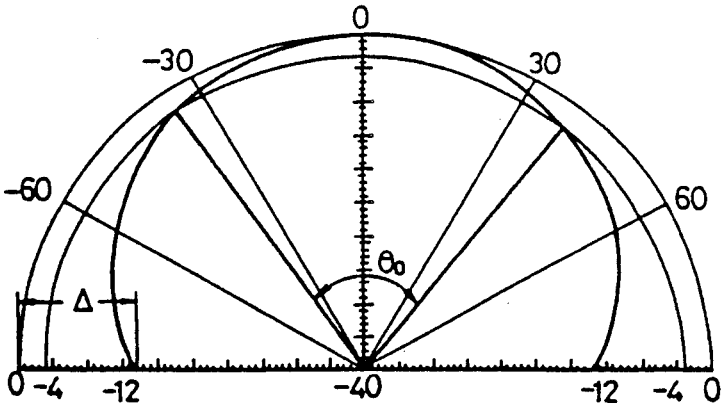
FIG. 4 shows an ideal radiating pattern.

Referring to FIG. 1, the radiating conductor sheet 1 is in the form of a rectangle having a longitudinal dimension W and a lateral dimension L. The dielectric sheet 2 and the ground conductor sheet 3 have identical dimensions except for the thickness and are rectangles similar to conductor sheet 1. Normals 10 which pass through the geometrical center of the radiating conductor sheet 1, the dielectric sheet 2 and the ground conductor sheet 3 are colinear. In the description to follow, the diagonal length (the length between the corners A and C) of radiating conductor sheet 1 is denoted by AC, the diagonal length of the ground conductor sheet 3 as measured between the corners G and G' by GG', and the thickness of the dielectric sheet 2 by h. A first microstrip antenna device A for circularly polarized waves of 1.58 GHz was prepared using a model DICLAD 522 (522 T 125 - 1150 available from Keene Company). A second microstrip antenna device B for circularly polarized waves of 1.571 GHz was prepared utilizing a model CU-CLAD 250 (250 DT 0625 - 50 - 11 available from 3M Company). Finally, a third microstrip antenna device C for circularly polarized waves of 2.433 GHz was prepared by utilizing the same model as that for the 1.571 GHz waves. The axial ratio, or the ratio of the electrical field strength of the vertically polarized wave to that of the horizontally polarized wave, of the radiated wave and the lateral depression Δ (see FIG. 4) were determined as the ratio GG'/AC was varied. Table 1 below indicates the various dimensions of the antenna devices A, B and C.

TABLE 1

| antenna | A | B | C |
|---|---|---|---|
| frequency (GHz) | 1.548 | 1.571 | 2.433 |
| radiating sheet thickness (mm) | 0.035 | 0.035 | 0.035 |
| ground sheet thickness (mm) | 0.035 | 0.035 | 0.035 |
| dielectric sheet thickness (mm) | 3.105 | 1.518 | 1.518 |
| W (mm) | 57.8 | 59.5 | 38.1 |
| L (mm) | 56.0 | 58.6 | 37.2 |
| AC (mm) | 80.48 | 83.51 | 53.25 |
| h/wavelength (%) | 1.60 | 0.79 | 1.23 |

Figure 5A:
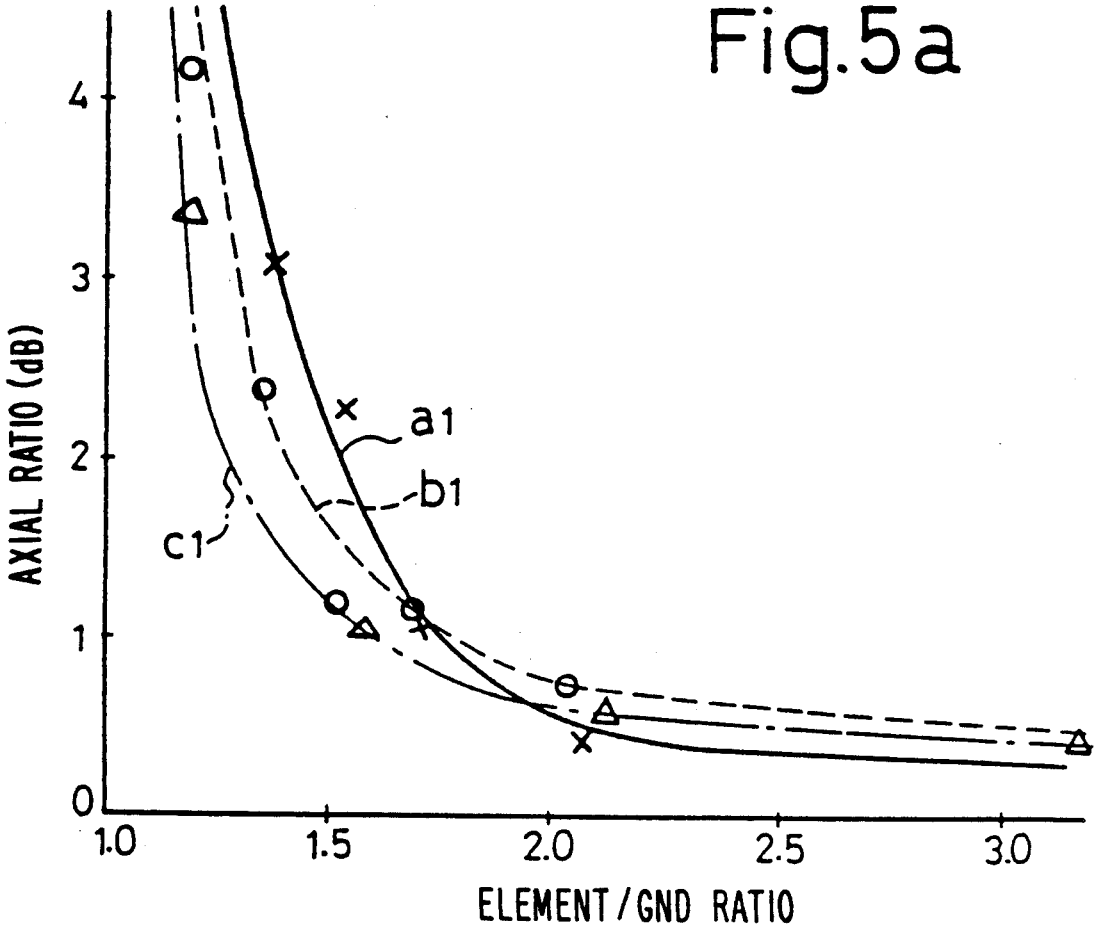
FIGS. 5*a*, 5*b* and 6 illustrate the responses of the microstrip antenna device of the embodiment as the ratio GG'/AC varies.

FIG. 5*a* illustrates the axial ratio of antenna devices A, B and C at several design frequencies as the ratio GG'/AC was varied. In this Figure, the results obtained with microstrip antenna device A are indicated by solid line a1 while the actual measurements are indicated by x. Similarly, the results obtained with antenna device B are indicated by broken line b1 with the actual measurements indicated by circles. The results obtained with antenna device C are indicated by phantom line c1 with the actual measurements shown by Δ. It is preferred that the axial ratio be close to 0 dB for circularly polarized waves. Referring to FIG. 5*a*, it is noted that the axial ratio of the antenna device A has a value approaching 3 dB when the ratio GG'/AC is equal to 1.5.

Figure 5B:
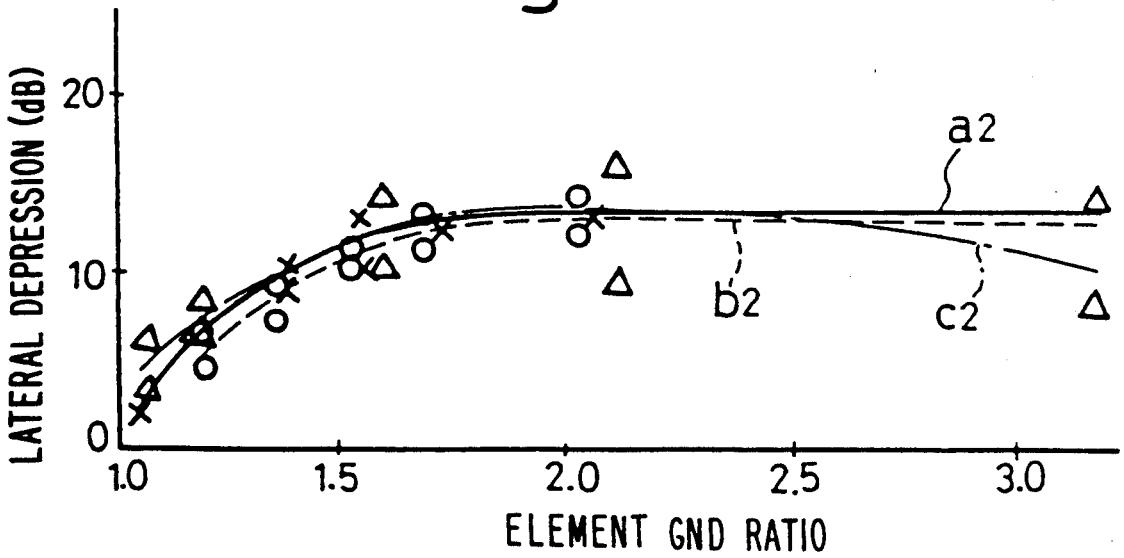

FIG. 5*b* graphically illustrates the lateral depression Δ of the individual antenna devices A, B and C at several design frequencies as the ratio GG'/AC was varied. The results of antenna device A are indicated by solid line a2 with the actual measurements indicated by x. The results of antenna device B are indicated by broken line b2 with the actual measurements indicated by circles. The results of antenna device C are indicated by phantom line curve c2 with the actual measurements indicated by Δ. It will be noted from FIG. 5*b* that the lateral depression is around 10 dB for each of the individual antenna devices A, B and C when the ratio GG'/AC is equal to 1.5, thus approaching the ideal value (14 dB).

Figure 6:
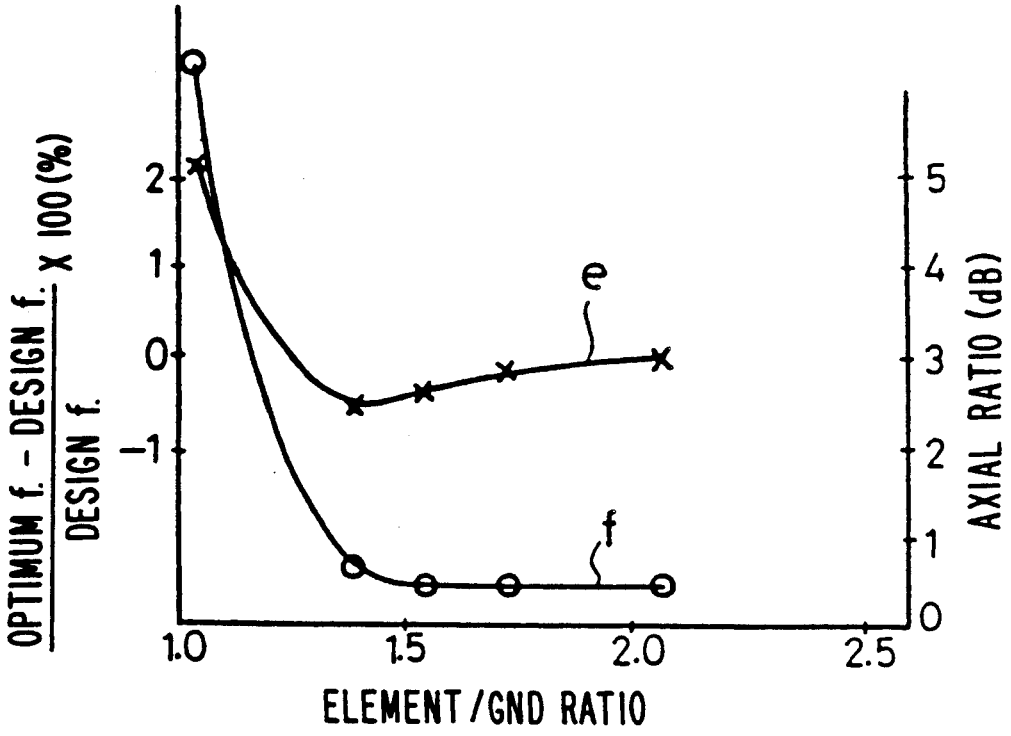

However, it was found that the optimum frequencies of the antenna vary with a change in the ratio GG'/AC. In FIG. 6, curve e indicates the deviation of the optimum frequency with respect to the design frequency (left ordinate) as the ratio GG'/AC varies for the antenna device A. Specifically, for antenna device A, the optimum frequency will be slightly below the design frequency when the ratio GG'/AC is equal to 1.5. Similar results are obtained with the remaining antenna devices. Determining the axial ratio of the antenna device A which employs the optimum frequency as the ratio GG'/AC is varied, a relationship as indicated by a curve f (right ordinate) results. It is apparent from the inspection of the curve f that the axial ratio at the GG'/AC ratio of 1.5 is close to 0 dB, indicating a favorable circular polarization response.

Figure 3:
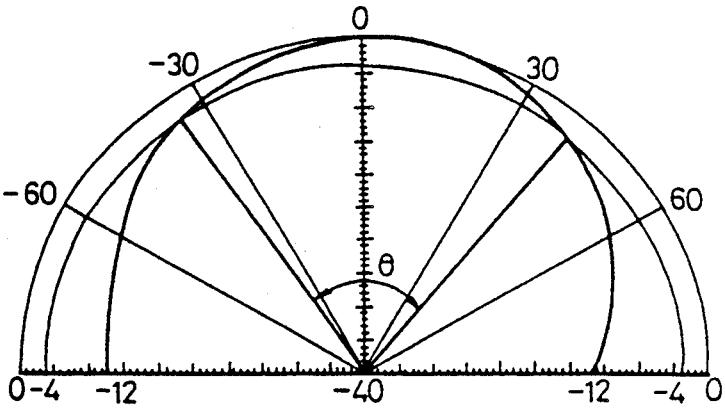
FIG. 3 shows a radiating pattern of the antenna device shown in FIGS. 1 and 2.

Antenna device A exhibits a radiating pattern as indicated by the thick solid line in FIG. 3. The half-value angle $\theta$ is equal to 75°, thus closely approaching the ideal pattern shown in FIG. 4. This means that by choosing a design frequency which is slightly above the frequency of use (by about 0.32%) and arranging the components so that a ratio of GG'/AC equal to or greater than 1.5 is achieved, one may obtain a microstrip antenna device for circularly polarized waves which is satisfactory for practical uses. In this instance, the dielectric sheet may have a thickness h which is equal to or less than 1.6% of the wavelength used.

As described, with the present invention, there is obtained a microstrip antenna device for circularly polarized waves of a minimum size which exhibits a satisfactory circular polarization, freedom from disturbances in the radiating pattern and which is satisfactory for practical purposes. By way of example, when the radiating conductor sheet member and the ground conductor sheet member are in the form of rectangles having coincident normals which pass through the center of the respective members, a microstrip antenna device for circularly polarized waves which is satisfactory for practical purposes is obtained when the diagonal ratio is equal to or greater than 1.5. In this manner, an efficient utilization of restricted space results.

What we claim is:

1. In a microstrip antenna device having a design frequency $V_{DES}$, said antenna comprising a dielectric sheet having a thickness h, a geometric center denoted by a point "o", and a point "b" positioned on the periphery thereof, a ground conductor sheet having a geometric center and substantially covering one surface of said dielectric sheet, and a radiating conductor sheet having a geometric center and a point "a" positioned on the periphery thereof and covering a portion of the other surface of the dielectric sheet, the points "a", "b", and "o" being colinear, said dielectric sheet, said ground conductor sheet, and said radiating conductor sheet having geometrically similar shapes and being arranged such that normals which are perpendicular to said sheets and which pass through the respective geometric centers of said sheets are substantially colinear, an improvement wherein said sheets are arranged such that the ratio of the distance between the points "o" and "b" to the distance between the points "o" and "a" is equal to or greater than 1.5 and less than or equal to 2.0.

2. The improved device according to claim 1 wherein the optimum frequency of use, $V_{USE}$, of the antenna device is smaller than the design frequency, $V_{DES}$, of the antenna device.

3. The improved device to claim 2 wherein $V_{USE}$ is approximately 0.32% less than $V_{DES}$.

4. The improved device according to claim 1 wherein said dielectric sheet, said ground conductor sheet, and said radiating conductor sheet all comprise rectangles.

5. The improved device according to claim 1 wherein the radiating conductor sheet and the dielectric sheet are substantially square.

6. In a microstrip antenna device having a design frequency $V_{DES}$, said antenna comprising a dielectric sheet having a thickness h, a geometric center denoted by a point "o", and a point "b" positioned on the periphery thereof, a ground conductor sheet having a geometric center and substantially covering one surface of said dielectric sheet, and a radiating conductor sheet having a geometric center and a point "a" positioned on the periphery thereof and covering a portion of the other surface of said dielectric sheet, the points "a", "b", and "o" being colinear, said dielectric sheet, said ground conductor sheet, and said radiating conductor sheet having geometrically similar shapes and being arranged such that normals which are perpendicular to said sheets and which pass through the respective geometric centers of said sheets are substantially colinear, a method of constructing the microstrip antenna including the step of:

choosing the dimensions of the ground conductor sheet and the radiating conductor sheet such that the ratio of the distance between the points "o" and "b" to the distance between the points "o" and "a" is equal to or greater than 1.5 and less than or equal to 2.0.

7. The method according to claim 6 further including the step of:

choosing the design frequency, $V_{DES}$, of the antenna device to be greater than the optimum frequency of use, $V_{USE}$, of the antenna device.

8. The method according to claim 7 wherein $V_{USE}$ is approximately 0.32% less than $V_{DES}$.

9. The method according to claim 6 wherein said dielectric sheet, said ground conductor sheet, and said radiating conductor sheet all comprise rectangles.

10. The method according to claim 6 wherein the radiating conductor sheet and the dielectric sheet are substantially square.

11. In microstrip antenna device having a design frequency $V_{DES}$, said antenna comprising a rectangular dielectric sheet having a thickness h, a geometric center denoted by a point "o", and a point "b" positioned on the periphery thereof, a ground conductor sheet having a geometric center and substantially covering one surface of said dielectric sheet, and a rectangular radiating conductor sheet having a geometric center and a point "a" positioned on the periphery thereof and covering a portion of the other surface of said dielectric sheet, the points "a", "b" and "o" being colinear, said dielectric sheet, said ground conductor sheet, and said radiating conductor sheet having geometrically similar shapes and being arranged such that normals which are perpendicular to said sheets and which pass through the respective geometric centers of said sheets are substantially colinear, an improvement wherein said sheets are arranged such that the ratio of the distance between the points "o" and "b" to the distance between points "o" and "a" is equal to or greater than 1.5 and less than or equal to 2.0 and the optimum frequency of use, $V_{USE}$, of the antenna device is smaller than the design frequency, $V_{DES}$, of the antenna device.

12. In a microstrip antenna device having a design frequency $\nu_{des}$, said antenna comprising a dielectric sheet having a thickness h, a geometric center denoted by a point "o", and a point "b" positioned on the periphery thereof, a ground conductor sheet having a geometric center and substantially covering one surface of said dielectric sheet, and a radiating conductor sheet having a geometric center and a point "a" positioned on the periphery thereof and covering a portion of the other surface of said dielectric sheet, the points "a", "b", and "o" being colinear, said dielectric sheet, said ground conductor sheet, and said radiating conductor sheet having geometrically similar shapes and being arranged such that normals which are perpendicular to said sheets and which pass through the respective geometric centers of said sheets are substantially colinear, and improvement wherein said sheets are arranged such that the ratio of the distance between the points "o" and "b" to the distance between the points "o" and "a" is approximately equal to 1.5.

13. The improved device according to claim 12 wherein the optimum frequency of use, $\nu_{use}$, of the antenna device is smaller than the design frequency, $\nu_{des}$, of the antenna device.

* * * * *